US008991009B1

(12) United States Patent
Russo et al.

(10) Patent No.: US 8,991,009 B1
(45) Date of Patent: Mar. 31, 2015

(54) ADJUSTABLE SELF-CLOSING BUTTERFLY FENCE HINGE

(71) Applicant: Barrette Outdoor Living, Inc., Middleburg Heights, OH (US)

(72) Inventors: Daniel Russo, Brecksville, OH (US); Antonello Nizzia, Turin (IT)

(73) Assignee: Barrette Outdoor Living, Inc., Middleburg Heights, OH (US)

( * ) Notice: Subject to any disclaimer, the term of this patent is extended or adjusted under 35 U.S.C. 154(b) by 0 days.

(21) Appl. No.: 14/228,455

(22) Filed: Mar. 28, 2014

Related U.S. Application Data

(63) Continuation of application No. 14/099,014, filed on Dec. 6, 2013.

(51) Int. Cl.
*E05F 1/14* (2006.01)
*E05D 7/00* (2006.01)

(52) U.S. Cl.
CPC ..... *E05D 7/00* (2013.01); *E05D 7/0009* (2013.01)
USPC ..... 16/285; 16/50; 16/298; 16/301

(58) Field of Classification Search
USPC ..... 16/50, 76, 85, 298–301, 285, 295, 307, 16/308, 386, DIG. 10; 49/386
See application file for complete search history.

(56) References Cited

U.S. PATENT DOCUMENTS

| | | | | |
|---|---|---|---|---|
| 924,422 | A | 6/1909 | Bommer | |
| 1,127,688 | A | 2/1915 | Smith | |
| 1,810,534 | A * | 6/1931 | Rubin | 16/301 |
| 2,072,094 | A * | 3/1937 | Bommer et al. | 16/299 |
| 2,248,493 | A | 7/1941 | Curtiss, Jr. | |
| 2,629,881 | A * | 2/1953 | Young | 4/240 |
| 2,777,157 | A | 1/1957 | Burke | |
| 3,510,986 | A * | 5/1970 | Berkowitz | 49/386 |
| 3,825,973 | A * | 7/1974 | Gwozdz | 16/300 |
| 4,339,845 | A * | 7/1982 | Newlon et al. | 16/300 |
| 4,419,788 | A * | 12/1983 | Prout | 16/300 |
| 4,570,291 | A | 2/1986 | Smith et al. | |
| 4,574,715 | A | 3/1986 | Dietrich, Sr. et al. | |
| 4,583,262 | A * | 4/1986 | Werner | 16/300 |
| 4,589,164 | A * | 5/1986 | Leonard | 16/299 |
| 4,845,811 | A * | 7/1989 | Fargnier | 16/308 |
| 5,048,155 | A * | 9/1991 | Hwang | 16/301 |
| 5,191,729 | A | 3/1993 | Verseef | |
| 5,991,975 | A | 11/1999 | Baer | |
| 6,178,694 | B1 | 1/2001 | Wagnitz | |
| 6,618,902 | B2 * | 9/2003 | Wu | 16/298 |

(Continued)

FOREIGN PATENT DOCUMENTS

| | | |
|---|---|---|
| WO | 9015912 | 12/1990 |
| WO | 2012174039 A1 | 12/2012 |

*Primary Examiner* — William Miller
(74) *Attorney, Agent, or Firm* — Luedeka Neely Group, PC

(57) ABSTRACT

An adjustable hinge includes a tension spring having a first end and an opposite second end, the second end of the tension spring being fixed relative to a swing arm hinge mount, a pin having a head including a plurality of projections about a circumference of the head and an opposite end of the pin spaced from the head. The projections of the head are configured to be received by the recesses of a base plate hinge mount, and the pin is positioned to extend through the base plate hinge mount and the swing arm hinge mount and to cooperate with the tension spring so that a first end of the spring is fixed relative to the head of the pin, and then the head of the pin is rotated the first end of the spring also rotates.

9 Claims, 11 Drawing Sheets

(56) References Cited

U.S. PATENT DOCUMENTS

| | | | | |
|---|---|---|---|---|
| 6,752,438 | B2 | 6/2004 | DeSouza | |
| 7,210,199 | B2 * | 5/2007 | Clark | 16/299 |
| 7,516,519 | B2 * | 4/2009 | Talpe | 16/316 |
| 8,245,353 | B2 * | 8/2012 | Homner et al. | 16/299 |
| 8,534,625 | B2 | 9/2013 | Heath et al. | |
| 8,549,707 | B2 * | 10/2013 | Macernis | 16/301 |
| 8,683,654 | B2 * | 4/2014 | Chen | 16/301 |
| 8,745,820 | B2 * | 6/2014 | Janak | 16/54 |
| 8,752,247 | B2 * | 6/2014 | Franchini | 16/334 |
| 2003/0200623 | A1 | 10/2003 | Hung | |
| 2004/0093689 | A1 | 5/2004 | Sosa et al. | |
| 2008/0179580 | A1 | 7/2008 | McGinness et al. | |
| 2011/0099754 | A1 | 5/2011 | Stull | |

* cited by examiner

ADJUSTABLE SELF-CLOSING BUTTERFLY FENCE HINGE

CROSS-REFERENCE TO RELATED APPLICATION

This application is a continuation-in-part of U.S. application Ser. No. 14/099,014 filed Dec. 6, 2013, and entitled Adjustable Self-Closing fence Hinge, incorporated by reference herein in its entirety.

FIELD

This disclosure relates to the field of fence hinges. More particularly, this disclosure relates to a butterfly fence hinge system configured to have an adjustable spring tension.

BACKGROUND

Gate hinges for fences desire improvement. Conventional self-closing (or self-opening) gate hinges desire improvement in that they are difficult to adjust the spring tension, or to wholly remove spring tension.

The present disclosure advantageously provides a spring-loaded butterfly fence hinge system that enables convenient adjustment of the spring tension, including complete removal of spring tension.

SUMMARY

The above and other needs are met by an adjustable self-closing fence hinge system.

In one aspect, the hinge system includes a base plate attachable to a fence post, the base plate including a base plate hinge mount having a bore with a plurality of internal recesses; a swing arm attachable to a fence gate and including a swing arm hinge mount; and a hinge mounted to the base plate hinge mount and the swing arm hinge mount for hingedly connecting the base plate and the swing arm to permit the swing arm to pivot relative to the base plate.

In one embodiment, the hinge includes a tension spring having a first end and an opposite second end, the second end of the tension spring being fixed relative to the swing arm hinge mount, a pin having a head including a plurality of projections about a circumference of the head and an opposite end of the pin spaced from the head. The projections of the head are configured to be received by the recesses of the base plate hinge mount, and the pin is positioned to extend through the base plate hinge mount and the swing arm hinge mount and to cooperate with the tension spring so that a first end of the spring is fixed relative to the head of the pin, and when the head of the pin is rotated the first end of the spring also rotates.

Tension of the spring is fixed when the pin head is seated in the base plate hinge mount with the projections of the head of the pin received in the recesses of the bore. Tension of the spring is adjustable by withdrawing the projections of the head of the pin from engagement with the recesses of the bore of the base plate hinge mount, then rotating the head of the pin to wind or unwind the tension spring to adjust the tension of the tension spring, and then positioning the projections of the head into engagement with the recesses of the bore of the base plate hinge mount, thereby fixing the tension of the tension spring at the adjusted tension.

A compression spring may be located between the swing arm hinge mount and the opposite end of the pin to urge the opposite end of the pin away from the base plate hinge mount. In such case, in connection with withdrawing the projections of the pin away from the recesses of the head, a force is applied to compress the compression spring to urge the head of the pin away from the base plate hinge mount.

In another embodiment, the hinge system includes a base plate attachable to a fence post, the base plate including a first base plate hinge mount having a bore with a plurality of internal recesses and a second base plate hinge mount spaced from the first base plate hinge mount. A swing arm is attachable to a fence gate, the swing arm and includes a first swing arm hinge mount and a second swing arm hinge mount spaced from the first swing arm hinge mount.

A hinge is mounted to the base plate hinge mounts and the swing arm hinge mounts for hingedly connecting the base plate and the swing arm to permit the swing arm to pivot relative to the base plate. The hinge includes a tension spring having a first end and an opposite second end, the second end of the tension spring being fixed relative to the first swing arm hinge mount. The hinge also includes a pin having a head including a plurality of projections about a circumference of the head and an opposite end of the pin spaced from the head. The projections are configured to be received by the recesses of the first base plate hinge mount. The pin is positioned to extend through the base plate hinge mounts and the swing arm hinge mounts and to cooperate with the tension spring so that a first end of the spring is fixed relative to the head of the pin so that when the head of the pin is rotated the first end of the spring also rotates. A compression spring is located between the second swing arm hinge mount and the opposite end of the pin to urge the opposite end of the pin away from the base plate hinge mounts.

Tension of the spring is fixed when the pin head is seated in the base plate hinge mount with the projections of the head of the pin received in the recesses of the bore. Tension of the spring is adjustable by applying force to compress the compression spring to urge the head of the pin away from the base plate hinge mount and withdrawing the projections of the head of the pin from engagement with the recesses of the bore of the base plate hinge mount, then rotating the head of the pin to wind or unwind the tension spring to adjust the tension of the tension spring, and then positioning the projections of the head into engagement with the recesses of the bore of the base plate hinge mount, thereby fixing the tension of the tension spring at the adjusted tension.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

With reference to the drawings, the disclosure relates to an adjustable self-closing butterfly hinge system 10. The hinge system 10 is configured to enable an adjustable closing or opening tension. The term self-closing as used herein will be understood to encompass reverse mounting of the hinge so as to be self-opening.

Figure 1:
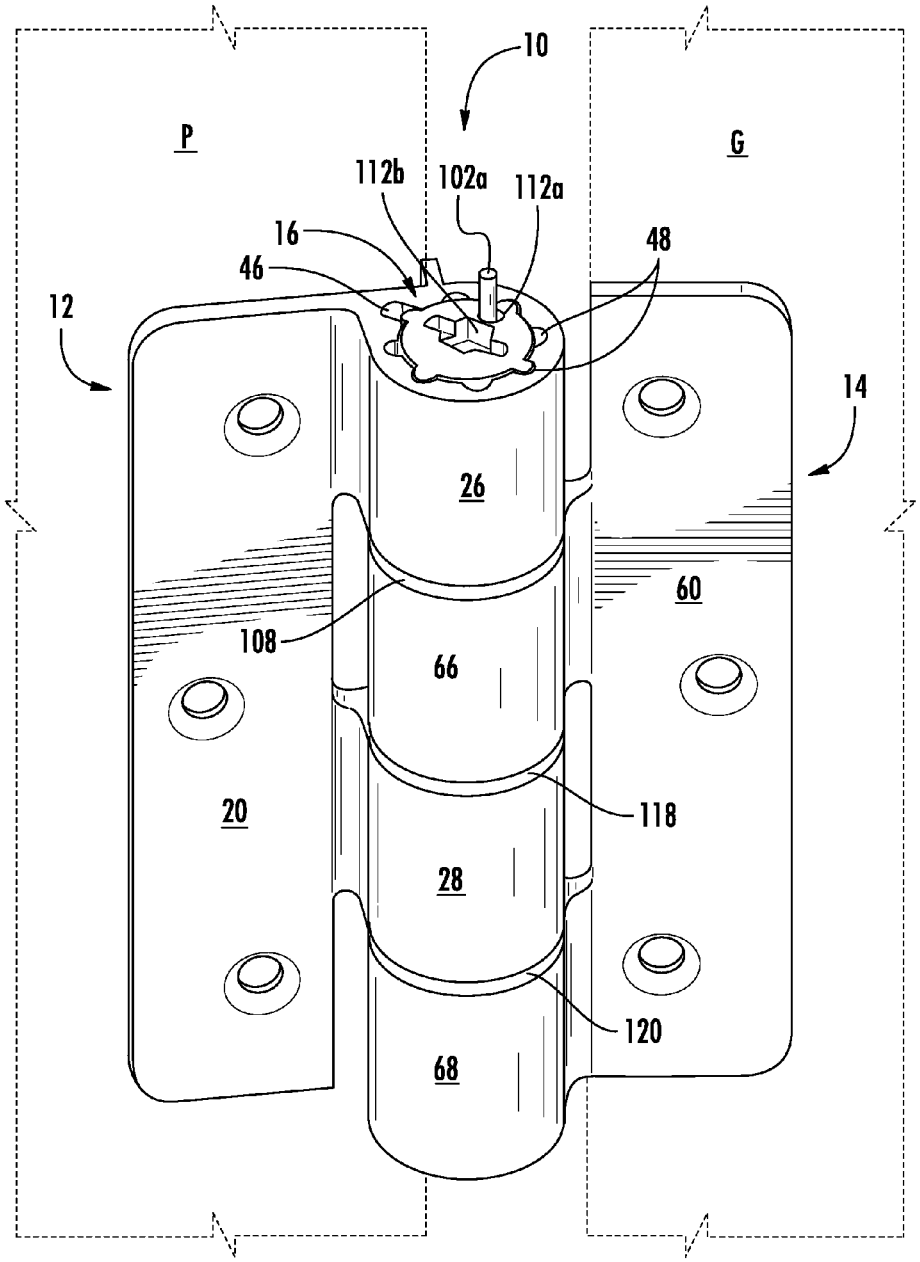
FIG. 1 is a frontal upper perspective view of a fence hinge system according to the disclosure as mounted onto a fence post and fence gate.
Figure 2:
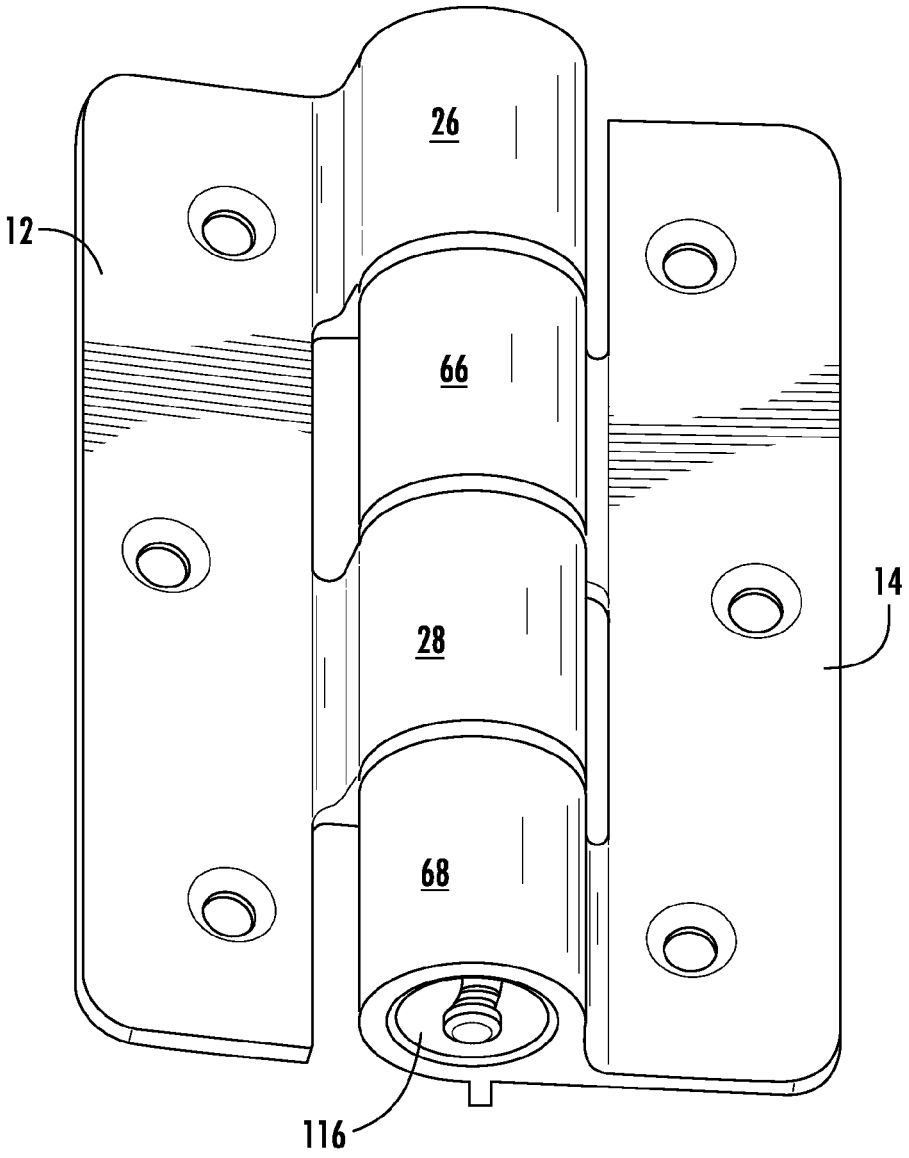
FIG. 2 is a frontal lower perspective view of the fence hinge system of FIG. 1.
Figure 3:
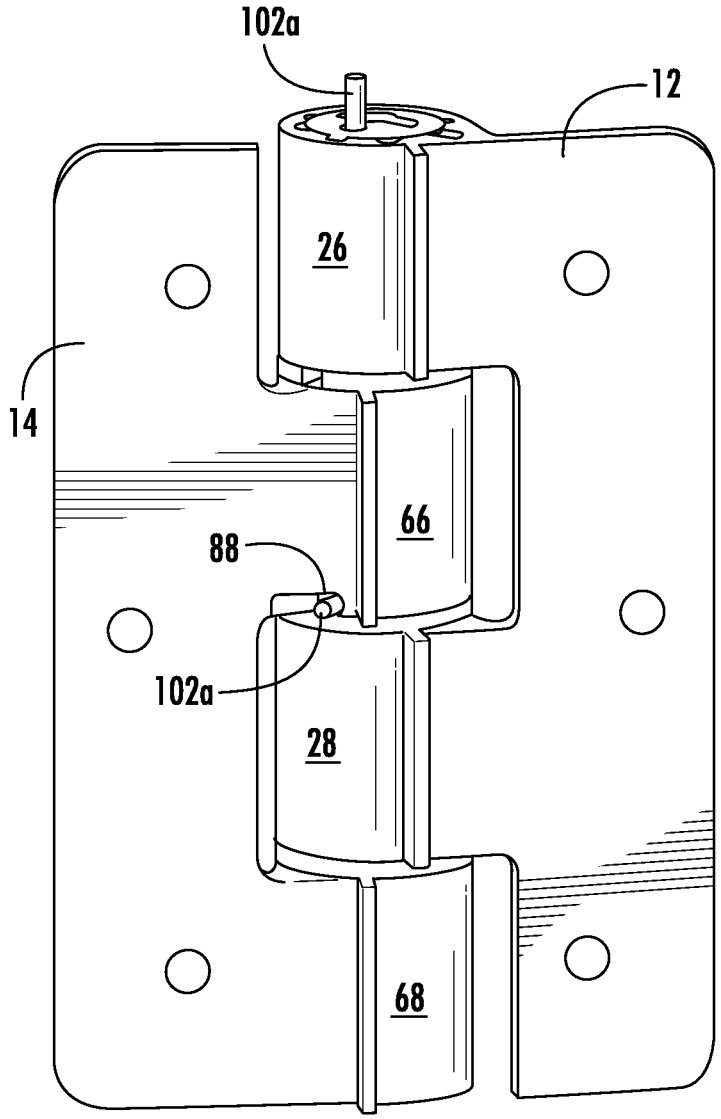
FIG. 3 is a rear upper perspective view of the fence hinge system of FIG. 1.
Figure 4:
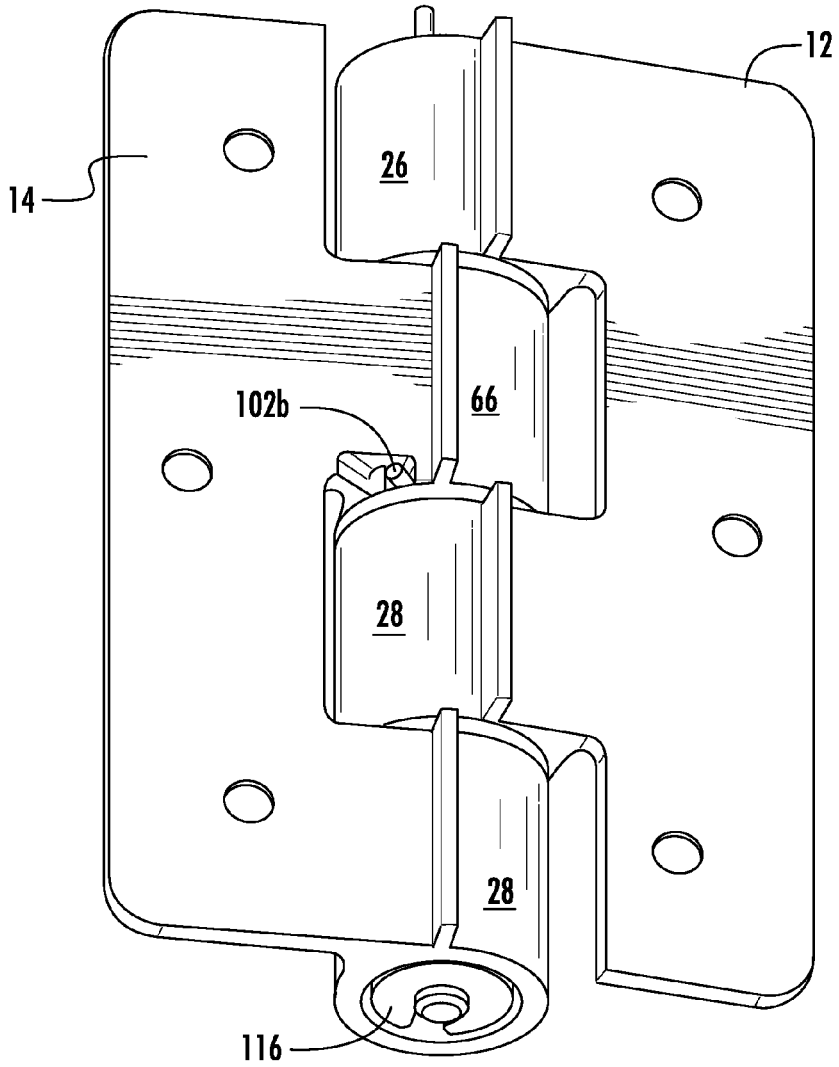
FIG. 4 is a rear lower perspective view of the fence hinge system of FIG. 1.
Figure 5:
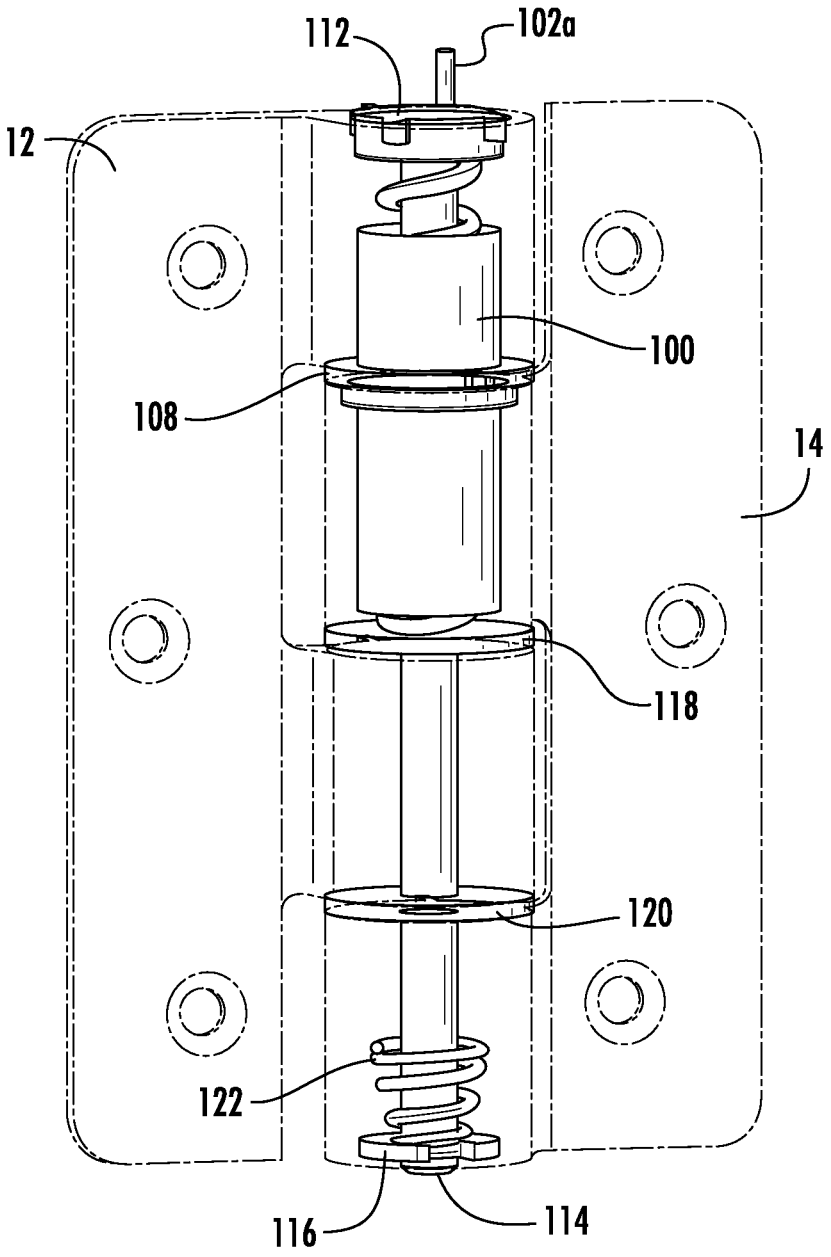
FIGS. 5 and 6 are front and rear perspective views of the fence hinge system of FIG. 1, with a base plate component and a swing arm component of the fence hinge system transparent to show a hinge component.

The hinge system 10 is configured for mounting onto a body, such as a post P and/or a gate G of a fence (FIG. 1), and includes a base plate 12, a swing arm 14, and a hinge 16.

The base plate 12 is desirably of one-piece stamped metal construction and is configured for mounting onto the post P. In this regard, the base plate 12 includes a front wall 20 mountable to the front of the post P and one or more lips 22 positionable against a side of the post adjacent the gate G. For use with a square post P, the front wall 20 and the lips 22 generally form an angle of 90 degrees. The front wall 20 includes mounting apertures 24 configured for receiving fasteners such as screws for mounting the base plate 12 to the post P. The front wall 20 includes outwardly extending and vertically spaced apart and aligned hinge mounts 26 and 28 onto which components of the hinge 16 are rotatably or pivotally mounted, as explained more fully below. The lips 22 are preferably located adjacent to and extend from the hinge mounts 26 and 28.

The mounts 26 and 28 extend from an edge 30 of the base plate 12 so as to extend in a direction toward the swing arm 14 when the hinge 10 is assembled. The mount 26 is located adjacent an end 32 of the base plate 12. The mount 28 is spaced from the mount 26, and spaced from an opposite end 34 of the base plate 12, to define a gap G between the mounts 26 and 28.

The mount 26 is generally configured as a cylinder, having a generally circular through-bore 40 with opposite open ends 42 and 44. A longitudinal groove 46 is defined along the length of the bore 40 and extends through both of the ends 42 and 44. The end 42 and a portion of the bore 40 adjacent the end 42, typically about half of the length of the bore 40, is configured to include a plurality of uniformly spaced apart recesses 48.

The mount 28 is generally configured as a filled cylinder, but having a circular and centrally located through-bore 50 with opposite open ends 52 and 54. The bore 50 is small at the end 52, but may increase in diameter at the end to provide a countersunk opening 56 so that a reduced surface area is provided for reducing friction for opening and closing of the hinge.

The swing arm 14 is desirably of one-piece metal construction and is configured for mounting onto the gate G. In this regard, includes a front wall 60 mountable to the front of the gate G and one or more lips 62 positionable against a side of the gate G adjacent the post P, with the front wall 60 and the lips 62 generally form an angle of 90 degrees. The front wall 60 includes mounting apertures 64 configured for receiving fasteners such as screws for mounting the swing arm 14 to the gate G. The front wall 60 includes outwardly extending and vertically spaced apart and aligned hinge mounts 66 and 68 onto which components of the hinge 16 are rotatably or pivotally mounted, as explained more fully below. The lips 62 are preferably located adjacent to and extend from the hinge mounts 66 and 68.

The mounts 66 and 68 extend from an edge 70 of the swing arm 14 so as to extend in a direction toward the base plate 12 when the hinge 10 is assembled. The mount 66 is located adjacent an end 72 of the swing arm 14. The mount 68 is spaced from the mount 66, and spaced from an opposite end 74 of the swing arm 14, to define a gap G' between the mounts 66 and 68. In this regard, the gap G of the mounts 26 and 28 cooperates with the gap G' of the mounts 66 and 68 to provide a dove-tailed fit of the mounts of the base 12 and the mounts of the swing arm 14. Thus, the mount 66 of the swing arm 14 fits between the mounts 26 and 28 of the base plate 12, and the mount 28 of the base plate 12 fits between the mounts 66 and 68 of the of the swing arm 14.

The mount 66 is generally configured as a cylinder, having a generally circular through-bore 80 with opposite open ends 82 and 84. A longitudinal groove 86 is defined along the length of the bore 80 and extends through both of the ends 82 and 84. An interior lip 80*a* is located on the bore 80 adjacent the end 82. A notch 88 is defined through the sidewall of the mount 66 adjacent the end 84.

The mount 68 is generally configured as a filled cylinder, but having a circular and centrally located through-bore 90 with opposite open ends 92 and 94. The bore 90 is small at the end 92, but increases in diameter in a stepped configuration at the end 94, so as to provide a stepped, concentric opening 96.

The hinge 16 includes a tubular hinge housing 100 enclosing a hinge spring 102, and a spring adjustment system 104 that cooperates with the base plate 12, the swing arm 14 to enable adjustment of the tension of the hinge spring 102.

The tubular housing 100 of the hinge 16 is preferably of metal construction and includes a through bore 106 sized to receive the spring 102. The spring 102 is preferably a torsion spring having opposite ends 102*a* and 102*b*. A flanged split ring 108 receives the housing 100 and is positioned to interface between the mounts 26 and 66 to provide a smooth pivot surface to facilitate pivotal movement of the swing arm 14 relative to the base plate 12. The flange portion of the split ring 108 is configured to seat on the lip 80*a* of the mount 66.

Figure 6:
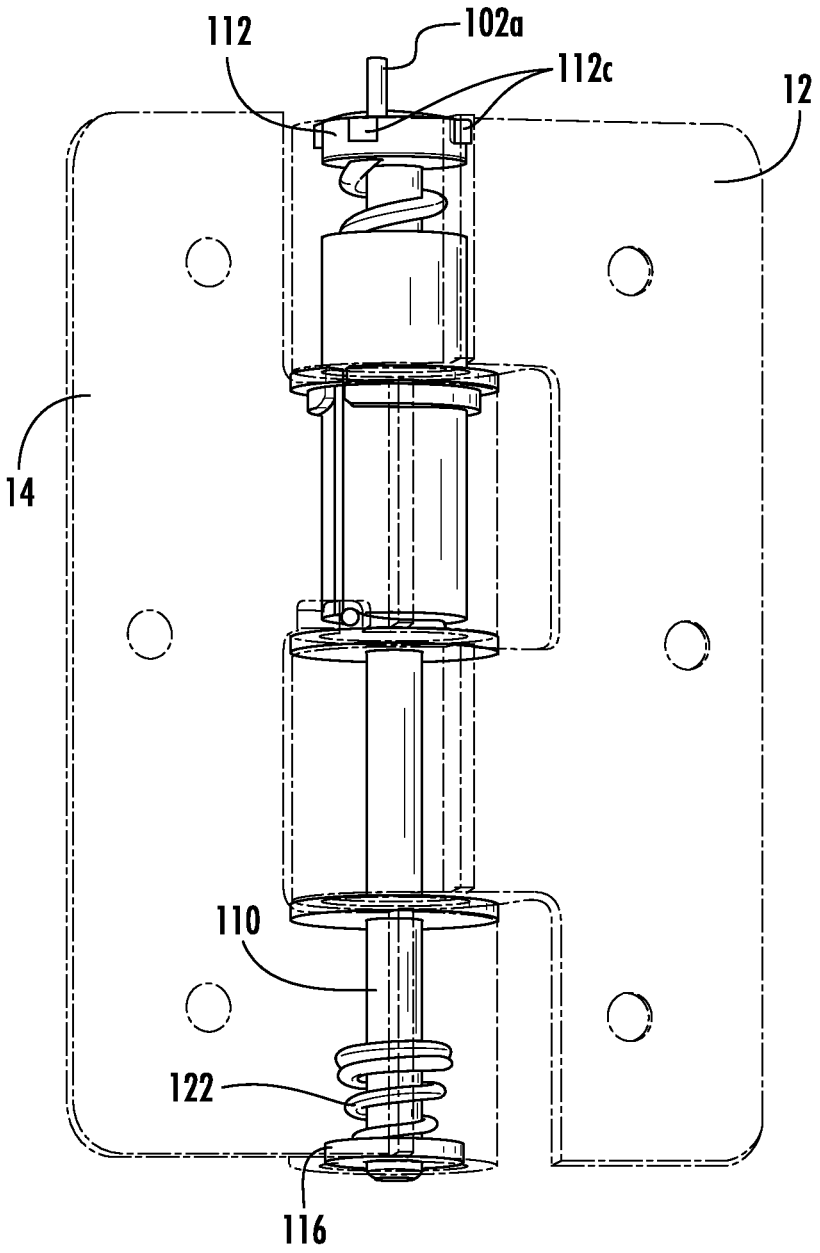
Figure 7:
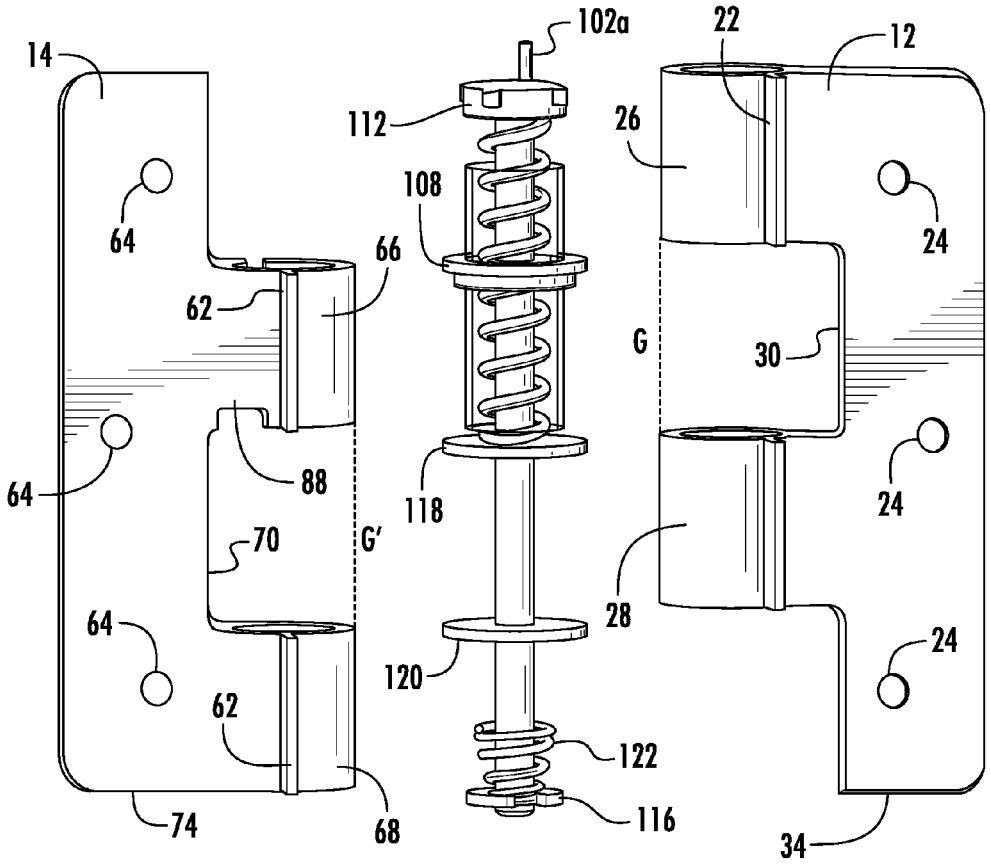
FIGS. 7 and 8 are partially exploded views of the fence hinge system of FIG. 1.
Figure 8:
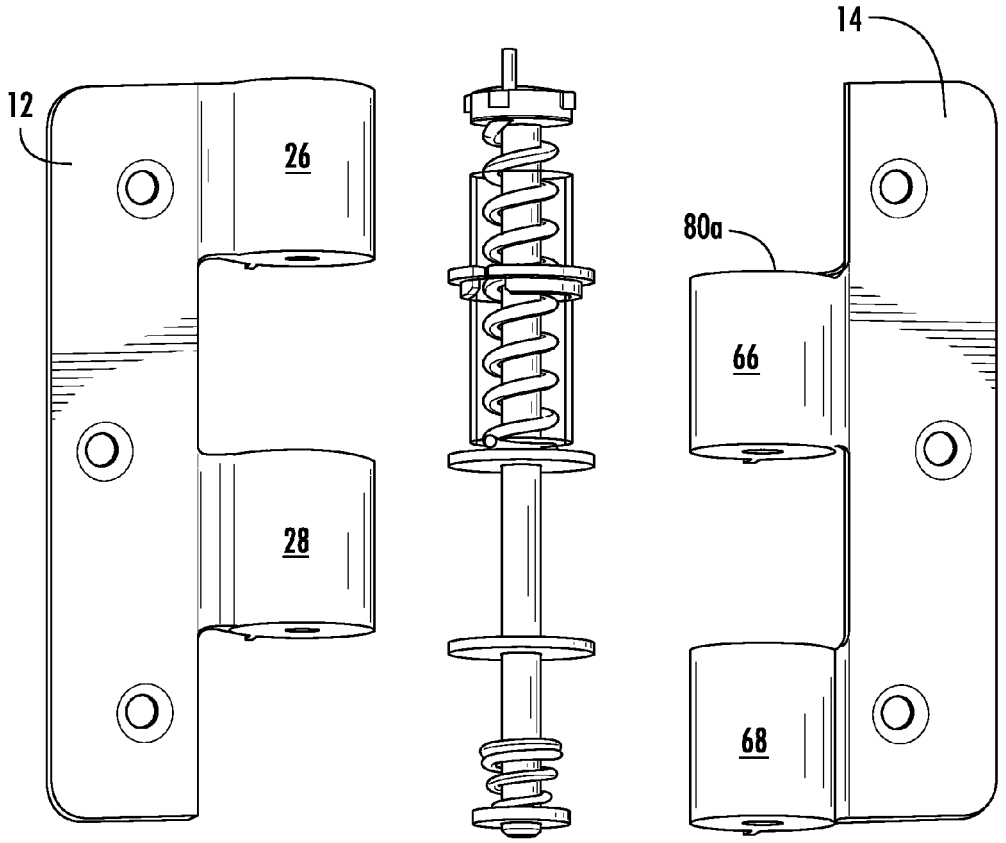
Figure 9:
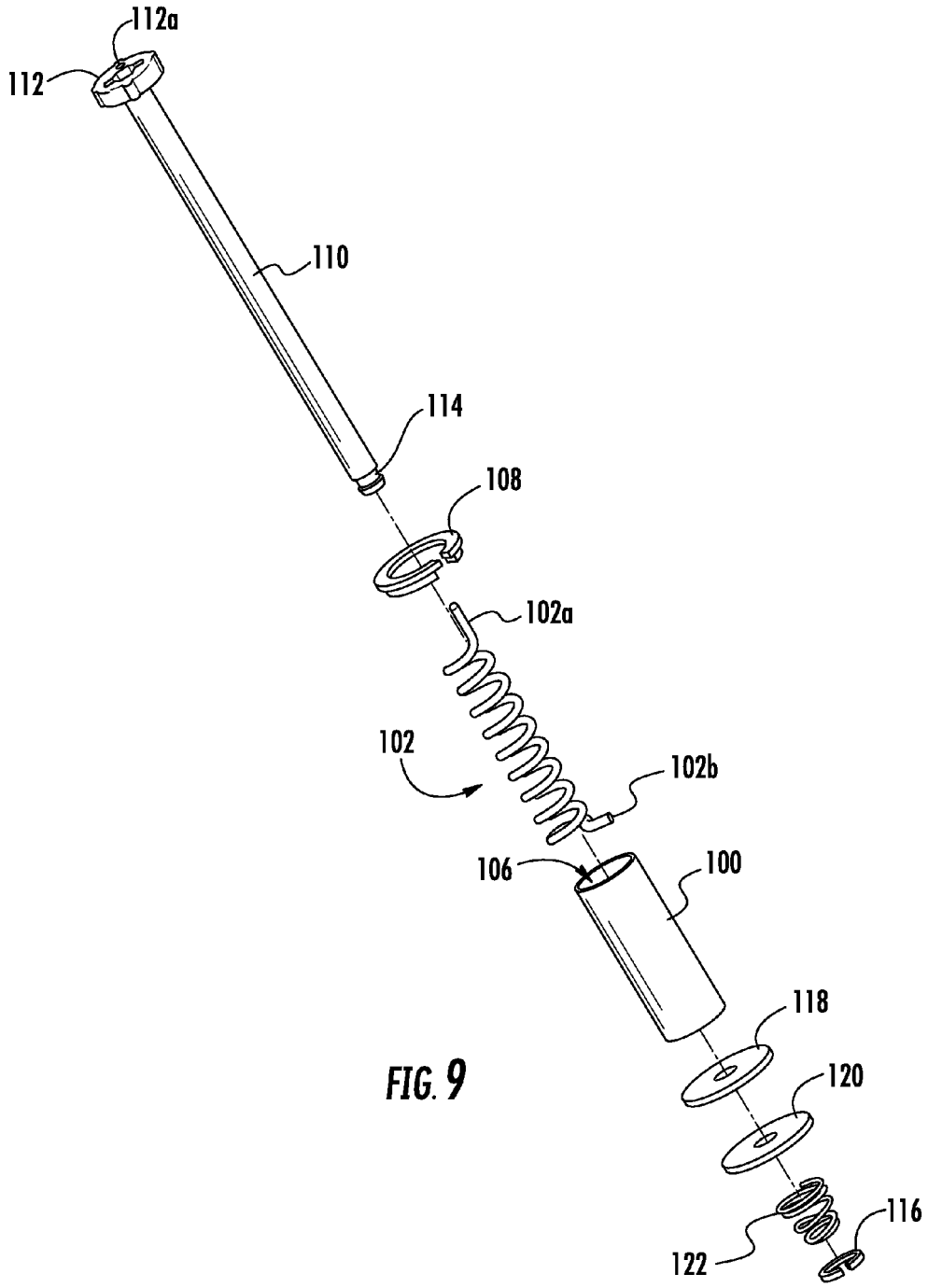
FIG. 9 is an exploded view showing hinge components.
Figure 10:
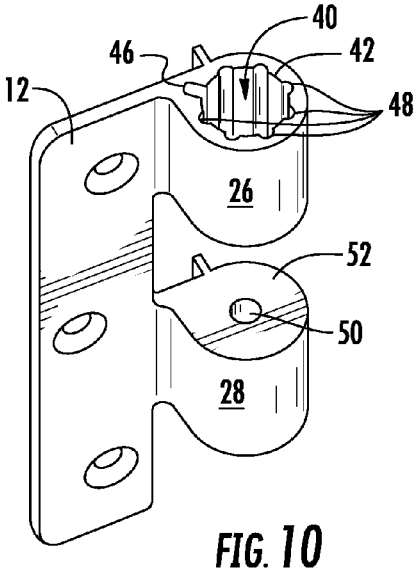
FIGS. 10 and 11 are perspective views of a base plate component of the fence hinge system of FIG. 1.
Figure 11:
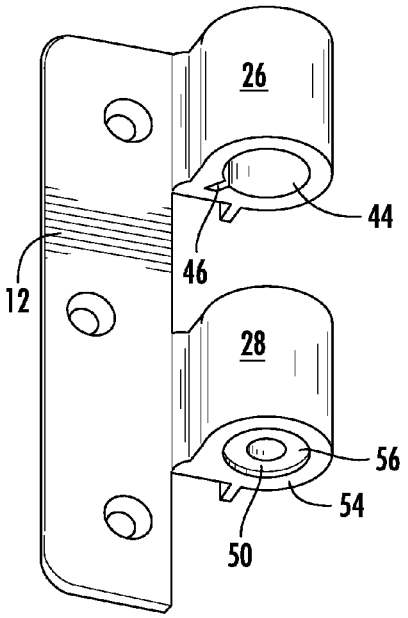
Figure 12:
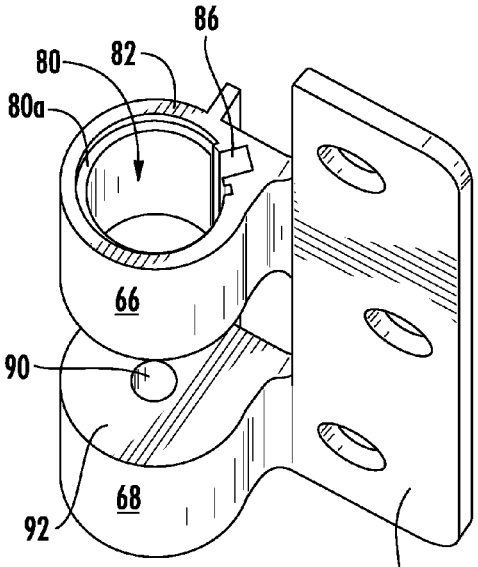
FIGS. 12 and 13 are perspective views of a swing arm component of the fence hinge system of FIG. 1.
Figure 13:
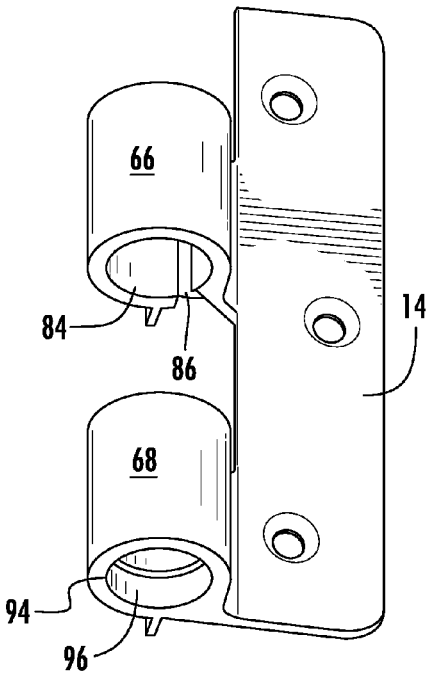

The spring adjustment system 44 includes an index pin 110 having a head 112 and an opposite grooved end 114 onto which is seated a fastener, such as a C-clip 116. The head 112 includes an aperture 112*a* extending through the thickness of the head 112 for receiving the end 102*a* of the spring 102. The head 112 also includes a drive surface 112*b* for receiving a driver head. For example, the drive surface 112*b* may be configured to have a slot for receiving a screwdriver blade and/or a hexagonal recess for receiving a hex key or Allen wrench, or other driver configuration. The perimeter of the head 112 includes a plurality of spaced apart projections 112*c* (FIG. 6) arranged and configured to seat into the recesses 48 (FIG. 10) of the bore 40 of the mount 26 to maintain a desired tension of the spring 102, and to permit adjustment of the tension of the spring 102.

The number of the recesses 48 preferably exceeds the number of the projections 112*c* such that the index pin 110 may be incrementally positioned from one position to another. For example, as shown, the head 112 includes four of the projections 112*c*, while the bore 40 includes eight of the recesses 48. Thus, the index pin 110 may be incrementally rotated as little as one-eighth of a turn during adjustment of the index pin 110 to tension or untension the spring 112 of the hinge 16, as explained more fully below. If desired, the projections 112*c* and the recesses 48 may be configured to enable even smaller adjustment increments.

A pair of washers 118 and 120 receive the pin 110 and center it within the mounts 28, 66, and 68. The washers 118 and 120 are positioned to interface between the mounts 28, 66, and 68 to provide a smooth pivot surface to facilitate pivotal movement of the swing arm 14 relative to the base plate 12. A compression spring 122 is positioned within the mount 68 around the pin 110 adjacent the grooved end 114, with the compression spring 122 and the c-clip 116 seated in the stepped opening 96 of the mount 68 when the hinge 16 is assembled.

In the assembled state of the hinge system 10, the hinge 16 is supported by the mounts 26 and 28 of the base plate 12 and the mounts 66 and 68 of the swing arm 14, and the tension of the spring 102 controls the self-closing (or self-opening) characteristics of the hinge 10. The spring 102 is located so that the pin 110 passes through the coils of the spring 102, and the end 102*a* of the spring 102 is held in the aperture 112*a* of the head 112 of the pin 110 and the end 102*b* of the spring 102 is fixed in the notch 88 of the mount 66. The head 112 of the pin 110 is seated in the bore 40 so that the projections 112*c* of the head 112 of the pin are seated into the recesses 48 of the bore 40 of the mount 26, with the head 112 flush with the end 42 of the mount 26. The projections 112*c* of the head 112 as seated in the recesses 48 prevent the head from rotating and thus maintains the tension of the spring 102, with the end 102*a* of the spring 102 captured in the aperture 112*a* of the head 112 and the end 102*b* of the spring 102 captured in the notch 88 of the mount 66. The compression spring 122 bears against the end 94 of the mount 68 and the c-clip 116 fixed to the grooved end 114 of the pin 110. The compression spring 122 thus urges the head 112 to remain seated in the end 42 of the mount 26, with travel of the head 112 toward the end 44 of the mount 26 limited by the length of the recesses 48.

Figure 14:
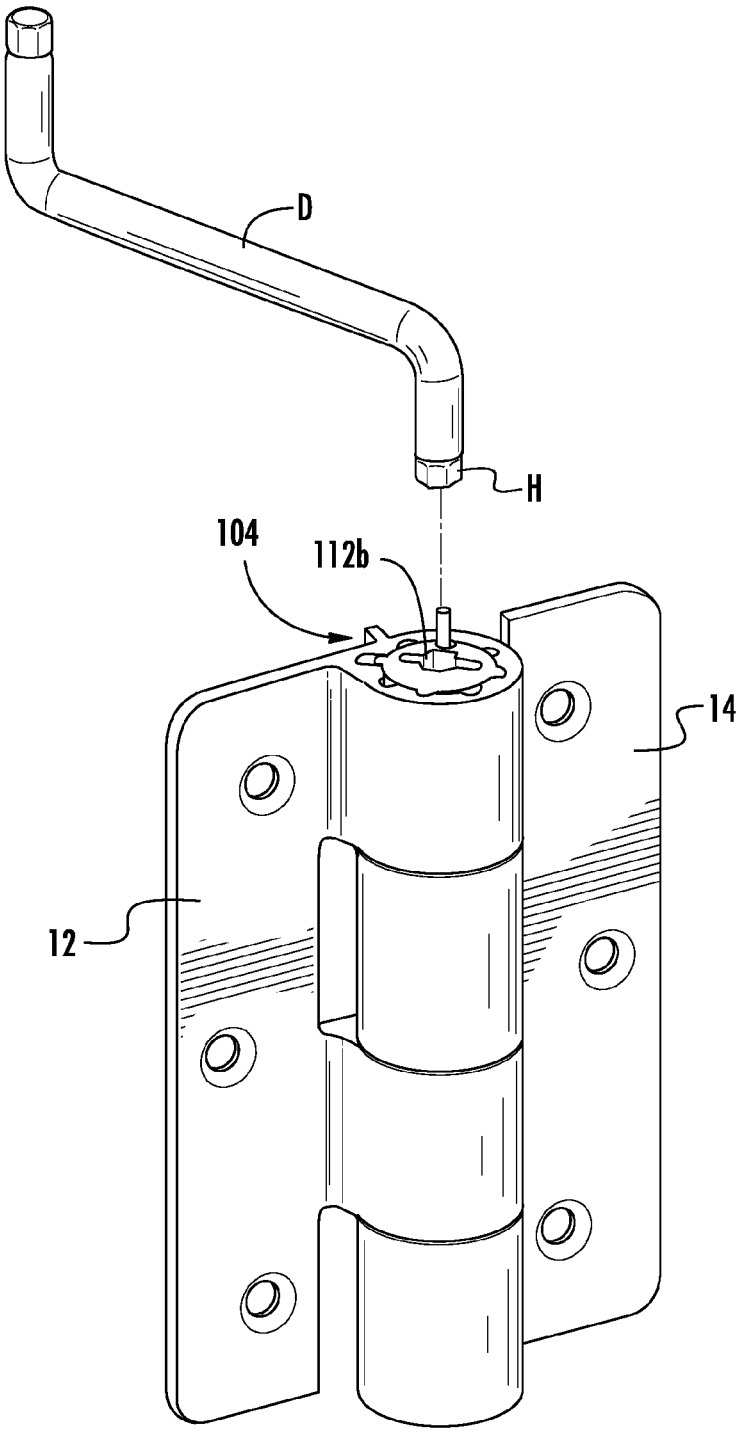
FIG. 14 depicts adjustment of spring tension of the hinge system of FIG. 1.

To adjust the tension of the spring 102, the head 112 may be released from engagement with the recesses 48 and rotated clockwise to increase spring tension, or counterclockwise to decrease spring tension, and the head 112 reseated in the recesses 48 to fix the adjusted tension. For example, with reference to FIG. 14, there are shown example steps for adjustment of the tension of the spring 102.

In a first step, a head H of a driver D, such as an Allen wrench is engaged with the drive surface 112*b* of the head 112 of the index pin 110. Then, force is exerted on the grooved end 114 of the pin 110 to compress the compression spring 122 and urge the head 112 out of engagement with the mount 26, while maintaining pressure on the driver D to prevent rotation of the head 112. The driver D may be used to rotate the head 112 in a counter-clockwise direction to wind or increase tension of the spring 102, or in a clockwise direction to unwind or decrease tension of the spring 102. When tension is adjusted as desired, pressure is released from the grooved end 114 of the pin 110 and the head 112 is re-seated in mount 26 with the projections 112*c* of the head 112 seated in the recesses 48 to maintain the adjusted spring tension.

In regard to tightening or loosening of the spring 102, in either case, the adjustment of the index pin 110 by turning the head 112 should be limited to no more than about one-quarter of a turn. For the configuration of the head 112 and the bore 40 with the recesses 48 as noted above, one-quarter turn would correspond to one of the projections 112*c* moving into one of the recesses 48 located two away from the starting recess 48. It is preferred that indicium or indicia, such as plus (+) and minus (−) symbols be provided on the exterior of the mount 26 to indicate which direction to rotate the head 112 to tighten or loosen the spring 102.

To disable the self-closing or self-opening feature of the hinge system 10, the above described procedure is accomplished, except that the head 112 is turned one full turn from the fully tensioned position to substantially untension to the spring. To re-engage the self-closing feature, the procedure is reversed and the head 112 is turned one full turn form the disabled position to return the spring to the fully tensioned state. If desired, the tension may then be reduced as described above.

As will be appreciated, the described hinge system 10 advantageously provides a butterfly hinge system configured to have an adjustable closing (or opening) tension.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. An adjustable self-closing fence hinge system, the hinge system comprising:

a base plate attachable to a fence post, the base plate including a base plate hinge mount having a bore with a plurality of internal recesses;

a swing arm attachable to a fence gate and including a swing arm hinge mount;

a hinge mounted to the base plate hinge mount and the swing arm hinge mount for hingedly connecting the base plate and the swing arm to permit the swing arm to pivot relative to the base plate, the hinge comprising:

a tension spring having a first end and an opposite second end, the second end of the tension spring being fixed relative to the swing arm hinge mount, a pin having a head including a plurality of projections about a circumference of the head and an opposite end of the pin spaced from the head, the projections configured to be received by the recesses of the base plate hinge mount, the pin positioned to extend through the base plate hinge mount and the swing arm hinge mount and to cooperate with the tension spring so that the first end of the tension spring is fixed relative to the head of the pin so that when the head of the pin is rotated the first end of the tension spring also rotates, and a compression spring located between the swing arm hinge mount and the opposite end of the pin to urge the opposite end of the pin away from the base plate hinge mount, wherein tension of the tension spring is fixed when the pin head is seated in the base plate hinge mount with the projections of the head of the pin received in the recesses of the bore, and wherein tension of the tension spring is adjustable by applying force to compress the compression spring to urge the head of the pin away from the base plate hinge mount and withdrawing the projections of the head of the pin from engagement with the recesses of the bore of the base plate hinge mount, then rotating the head of the pin to wind or unwind the tension spring to adjust the tension of the tension spring, and then positioning the projections of the head into engagement with the recesses of the bore of the base plate hinge mount, thereby fixing the tension of the tension spring at the adjusted tension.

2. The fence hinge system of claim 1, wherein the tension spring surrounds a portion of the pin.

3. The fence hinge system of claim 2, wherein the second end of the tension spring is positioned within a notch defined on the swing arm hinge mount.

4. The fence hinge system of claim 1, wherein the head of the pin includes an aperture and the first end of the tension spring is fixed relative to the head of the pin by passing the first end of the tension spring into the aperture of the head of the pin.

5. The fence hinge system of claim 1, wherein the spring tension may be adjusted to substantially untension the tension spring so that the hinge system is no longer self-closing.

6. The fence hinge system of claim 1, wherein compression spring surrounds a portion of the pin.

7. The fence hinge system of claim 1, further comprising a hinge housing, wherein the tension spring is positioned within a hinge housing.

8. An adjustable self-closing fence hinge system, the hinge system comprising:

a base plate attachable to a fence post, the base plate including a base plate hinge mount having a bore with a plurality of internal recesses;

a swing arm attachable to a fence gate and including a swing arm hinge mount;

a hinge mounted to the base plate hinge mount and the swing arm hinge mount for hingedly connecting the base plate and the swing arm to permit the swing arm to pivot relative to the base plate, the hinge comprising:

a tension spring having a first end and an opposite second end, the second end of the tension spring being fixed relative to the swing arm hinge mount, and a pin having a head including a plurality of projections about a circumference of the head and an opposite end of the pin spaced from the head, the projections configured to be received by the recesses of the base plate hinge mount, the pin positioned to extend through the base plate hinge mount and the swing arm hinge mount and to cooperate with the tension spring so that the first end of the tension spring is fixed relative to the head of the pin so that when the head of the pin is rotated the first end of the tension spring also rotates, wherein tension of the tension spring is fixed when the pin head is seated in the base plate hinge mount with the projections of the head of the pin received in the recesses of the bore, and wherein tension of the tension spring is adjustable by withdrawing the projections of the head of the pin from engagement with the recesses of the bore of the base plate hinge mount, then rotating the head of the pin to wind or unwind the tension spring to adjust the tension of the tension spring, and then positioning the projections of the head into engagement with the recesses of the bore of the base plate hinge mount, thereby fixing the tension of the tension spring at the adjusted tension.

9. An adjustable self-closing hinge, the hinge comprising:

a base plate attachable to a fence post, the base plate including a first base plate hinge mount having a bore with a plurality of internal recesses and a second base plate hinge mount spaced from the first base plate hinge mount;

a swing arm attachable to a fence gate, the swing arm including a first swing arm hinge mount and a second swing arm hinge mount spaced from the first swing arm hinge mount, a hinge mounted to the base plate hinge mounts and the swing arm hinge mounts for hingedly connecting the base plate and the swing arm to permit the swing arm to pivot relative to the base plate, the hinge comprising:

a tension spring having a first end and an opposite second end, the second end of the tension spring being fixed relative to the first swing arm hinge mount, a pin having a head including a plurality of projections about a circumference of the head and an opposite end of the pin spaced from the head, the projections configured to be received by the recesses of the first base plate hinge mount, the pin positioned to extend through the base plate hinge mounts and the swing arm hinge mounts and to cooperate with the tension spring so that the first end of the tension spring is fixed relative to the head of the pin so that when the head of the pin is rotated the first end of the tension spring also rotates, and a compression spring located between the second swing arm hinge mount and the opposite end of the pin to urge the opposite end of the pin away from the base plate hinge mounts, wherein tension of the tension spring is fixed when the pin head is seated in the first base plate hinge mount with the projections of the head of the pin received in the recesses of the bore, and wherein tension of the tension spring is adjustable by applying force to compress the compression spring to urge the head of the pin away from the first base plate hinge mount and withdrawing the projections of the head of the pin from engagement with the recesses of the bore of the first base plate hinge mount, then rotating the head of the pin to wind or unwind the tension spring to adjust the tension of the tension spring, and then positioning the projections of the head into engagement with the recesses of the bore of the first base plate hinge mount, thereby fixing the tension of the tension spring at the adjusted tension.

* * * * *